US006851894B1

(12) United States Patent
Perret et al.

(10) Patent No.: US 6,851,894 B1
(45) Date of Patent: Feb. 8, 2005

(54) DEEP WATER TLP TETHER SYSTEM

(75) Inventors: Graham Perret, Sussex (GB); Henrik Hannus, Hövik (NO); Kjetil Eckhoff, Slependen (NO)

(73) Assignee: Aker Kvaerner Engineering & Technology AS, Lysaker (NO)

( * ) Notice: Subject to any disclaimer, the term of this patent is extended or adjusted under 35 U.S.C. 154(b) by 0 days.

(21) Appl. No.: 10/018,361

(22) PCT Filed: Jun. 22, 2000

(86) PCT No.: PCT/NO00/00215

§ 371 (c)(1),
(2), (4) Date: Mar. 20, 2002

(87) PCT Pub. No.: WO00/78601

PCT Pub. Date: Dec. 28, 2000

(30) Foreign Application Priority Data

Jun. 23, 1999 (NO) ..... 19993116

(51) Int. Cl.[7] ..... E02D 29/09
(52) U.S. Cl. ..... 405/223.1
(58) Field of Search ..... 405/224, 224.2, 405/224.3, 224.4, 223.1, 195.1, 197, 203, 204

(56) References Cited

U.S. PATENT DOCUMENTS

| | | | | | |
|---|---|---|---|---|---|
| 4,117,691 | A | * | 10/1978 | Spray | 405/197 |
| 4,187,038 | A | * | 2/1980 | Taylor | 405/204 |
| 4,740,109 | A | * | 4/1988 | Horton | 405/195.1 |
| 5,094,567 | A | * | 3/1992 | Nista et al. | 405/195.1 |
| 5,443,330 | A | * | 8/1995 | Copple | 405/195.1 |
| 5,683,206 | A | * | 11/1997 | Copple | 405/195.1 |

FOREIGN PATENT DOCUMENTS

| | | |
|---|---|---|
| GB | 1 509 503 | 5/1978 |
| GB | 2081659 | 2/1982 |
| NO | 1997 3045 | 6/1997 |
| NO | 1998 3796 | 8/1998 |

* cited by examiner

*Primary Examiner*—Michael Safavi
(74) *Attorney, Agent, or Firm*—Wenderoth, Lind & Ponack L.L.P.

(57) ABSTRACT

A tether system include tethers each having an upper section (1) attached to a tension leg platform (TLP) (4), and each upper section has a large diameter so that the upper section (1) is positively bouyant. This buoyancy can be designed to compensate for the weight of the lower section (2) of each tether, so as to make the total buoyancy of each tether closer to neutral. The selection process for each section is driven by requirements for buoyancy, stiffness and external pressure resistance.

17 Claims, 4 Drawing Sheets

TLP WITH TETHERS

TETHER STRING

TLP WITH TETHERS

TETHER STRING

DIAMETER TRANSITION

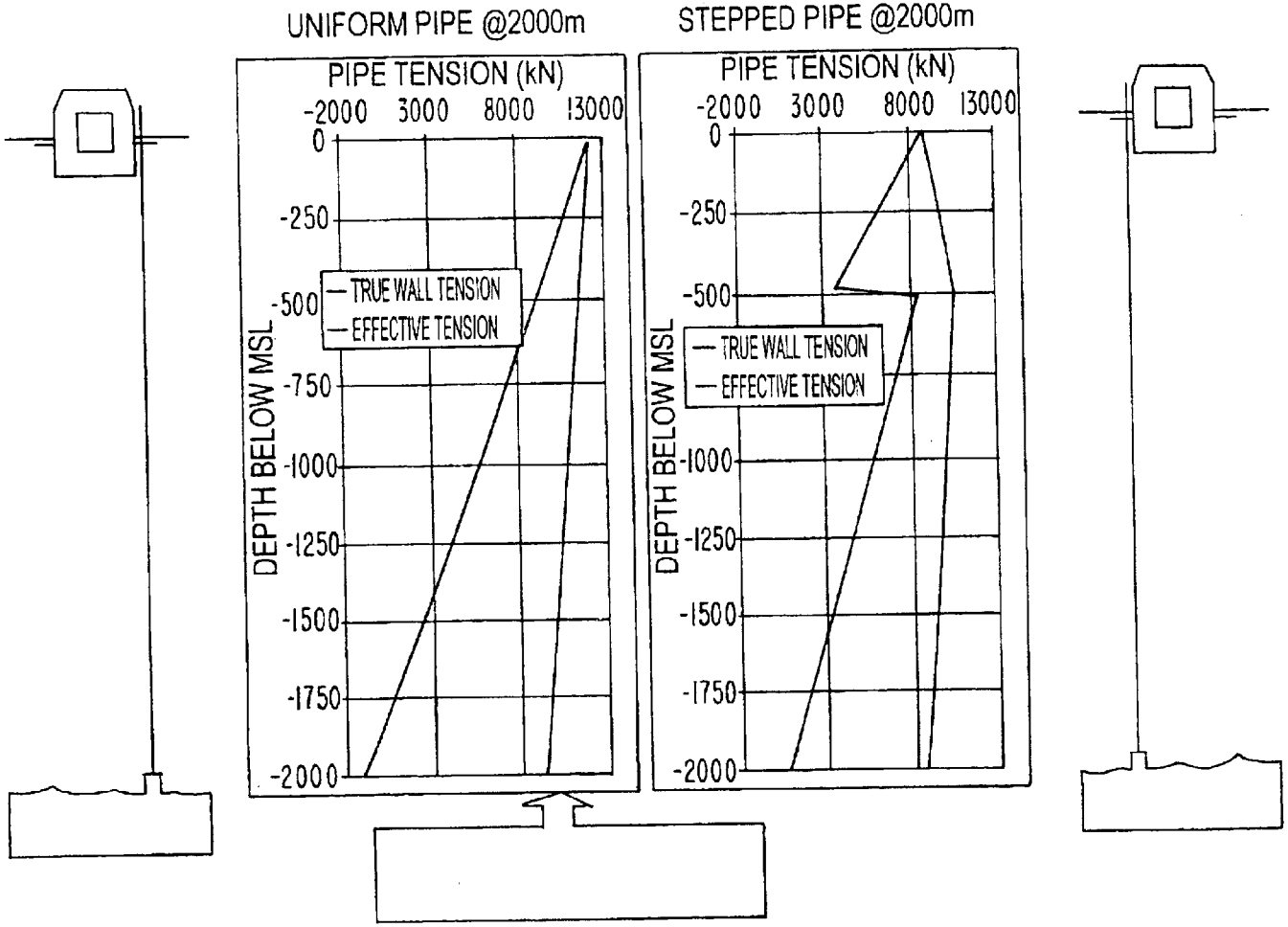
FIG. 4 TETHER PIPE TENSION

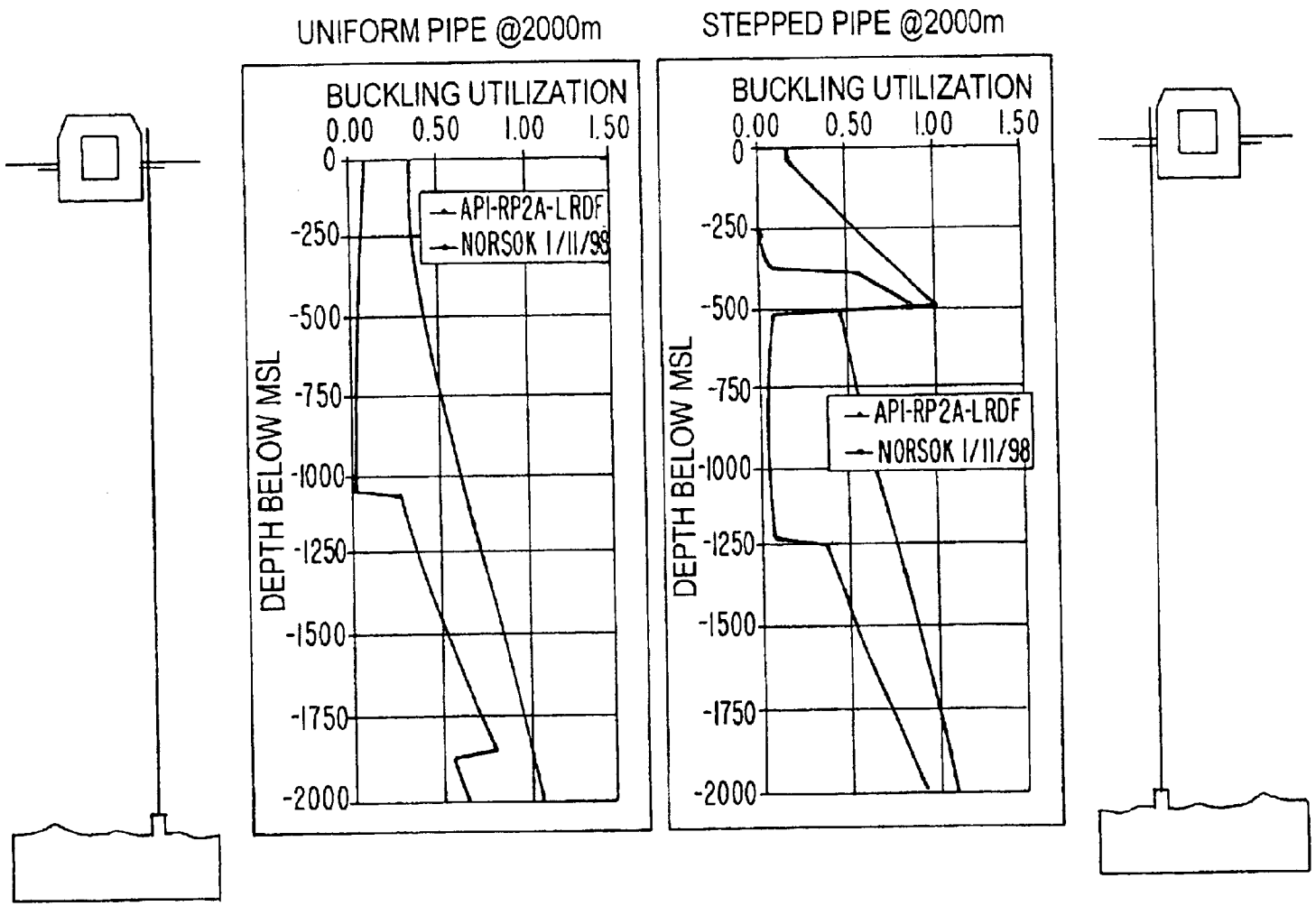
FIG. 5 TETHER PIPE UTILIZATION

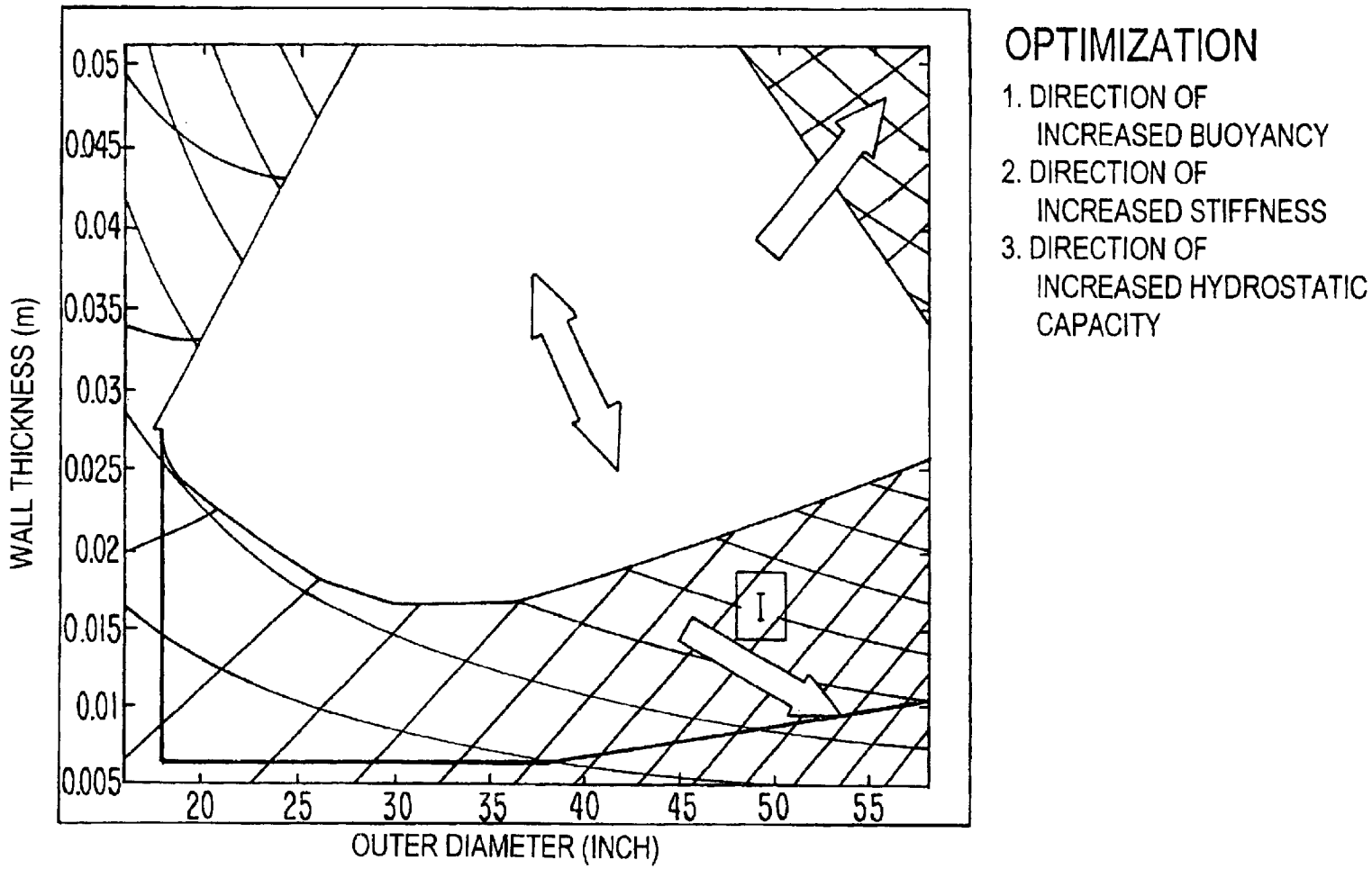
FIG. 6 OPTIMIZATION CHART

DEEP WATER TLP TETHER SYSTEM

BACKGROUND OF THE INVENTION

This invention relates to offshore structures and, more particularly, to tension leg platforms (TLP) for exploitation of deep sea hydrocarbon reserves.

Mooring elements, or tethers, on tension leg platforms are anchored to the seabed. They usually consist of steel pipes and are kept in tension by the buoyancy of the platform.

With the gradual depletion of onshore and shallow sub sea subterranean hydrocarbon reservoirs, the search for additional petroleum reserves is being extended into deeper and deeper waters. As such deeper reservoirs are discovered, increasingly complex and sophisticated production systems are being developed. It is projected that soon, off-shore exploration and production facilities will be required for probing depths of 1500 m or more.

One way of reaching these depths is by using Tension Leg Patforms. A TLP comprises a semi-submersible-type floating platform anchored to foundations on the sea bed through members or mooring lines called tension legs or tethers. The tension legs are maintained in tension at all times by ensuring that the buoyancy of the TLP exceeds its operating weight under all environmental conditions. The TLP is compliantly restrained by this mooring system against lateral offset allowing limited surge, sway and yaw. Motions in the vertical direction of heave, pitch and roll are stiffly restrained by the tension legs.

External flotation systems can be attached to the legs, but their long-term reliability is questionable. Furthermore, added buoyancy of this type causes an increase in the hydrodynamic forces on the leg structure.

TLPs based on today's technology are considered competitive down to 1,000–1,500 M. Beyond this depth, the tether system becomes increasingly heavy, requiring an increased platform size to carry the tether weight. This results in a larger platform, which has a significant impact on the overall cost.

For a TLP at 3,000 m, a conventional tether system (one thickness, one diameter) represents a weight almost equal to the payload. In previous designs, it has been proposed to reduce the wall thickness at the top to reduce the weight penalty. A solution to avoid these disadvantages related to the TLP is to modify the tether system to reduce the need for increased hull size. The industry has devoted a considerable effort to develop tether systems based on various designs. Filling tether pipes with low-density material, pressurizing the interior to increase the hydrostatic capacity, and replacing the steel tether pipes with composites are examples of these efforts.

Another solution can be found in NO 1997 3044, showing a design used for depths down to 700 m, built by pipe sections with a diameter between 0.5 and 1.2 m. The overall buoyancy of the tension leg is meant to be more or less neutral. This is achieved by adding an additional floating body at the top of the pipe.

NO 1997 3045 shows a welding connection on a tension leg. The publication shows two pipes having different diameters and wall thicknesses welded together.

GB 2 081 659 A shows a floating platform mooring system for use in exploiting sub sea oil shoals, and includes a platform structure and an array of vertical tubular anchoring lines connected to the upright of the platform structure and to anchoring blocks on the sea bed. The patent shows anchoring lines consisting of a steel tube having resistance to yield stresses and having upper and lower sections. The upper section is a steel rod with a flexural stiffness which decreases from its point of connection to the upright. The lower section of the anchoring line has a hollow configuration and is fixed to an anchoring block in order to achieve an optimum exploitation of the structural material.

However, the patent does not address the problems relating to the weight and pressure resistance of deep sea tension legs.

SUMMARY OF THE INVENTION

The object of the present invention is to overcome the above-mentioned deficiencies, and to design tethers for TLPs that reduce the necessary added payload on the platform due to the tether weight. This object is achieved by providing a TLP as described below.

The invention relates to a tether system for TLPs including tethers having upper and lower pipe sections, in which the tethers having a reduced diameter towards the seabed. The invention is a concept for modifying today's technology for use in ultra deep waters. By introducing reductions in the tether diameter, the lower sections of the tether towards the sea bed will normally be negatively buoyant because of the considerable wall thickness necessary to withstand the hydrostatic pressure. The upper sections can more easily be made buoyant (due to less wall thickness), because the hydrostatic pressure is lower closer to the surface. This will help to balance the overall weight of the upper and lower sections.

The tether pipes are dimensioned to carry the tension from a platform consisting of a nominal pre-tension plus the tension variation due to functional and environmental loads. The pipes are kept empty (i.e. empty and hollow) to reduce the weight and increase buoyancy. The pipes must not only be designed to withstand the loads applied by the platform, but must also be able to able to resist hydrostatic pressure from the surrounding sea. This becomes more prominent as the depth and hydrostatic pressure increases. At great depths (in the order of 1,000 m) the pipes can no longer be designed to have a neutral buoyancy (a diameter to thickness ratio of about 30). In order to withstand the pressure, the diameter to thickness ratio has to be reduced, which results in added load on the platform.

The thickness of each section is sized according to capacity. It should also be considered that the tether vertical stiffness is critical for performance, and it is therefore favorable to maintain a fairly equal stiffness and length of each section.

The reduction in overall diameter will typically be made in steps, with intersections between the steps. The number of steps will depend on the length of the tether (i.e., the depth at which the tether will be used). In-between each diameter, a transition piece carries the load. This is a well-proven detail from previous TLP designs. The tethers may have a gradual transition between the upper and lower sections instead of the above described steps, but such tethers are less likely to be used because such tethers probably will require a more complex manufacturing process.

With the neutral tethers, the reduction of the hull weight is in the order of 30 percent as compared to the hull weight when tethers according to the prior art are used. This is due to the decrease of added payload when tethers of the invention are used.

BRIEF DESCRIPTION OF THE DRAWINGS

The invention will now be explained in more detail, with reference to the drawings in which:

FIG. 4 is a graph comparing the tension distribution of a uniform diameter pipe and a stepped diameter pipe;

FIG. 5 is a graph comparing tether pipe utilization of the uniform diameter pipe and the stepped diameter pipe; and FIG. 6 is an optimization chart on which an outer diameter and a wall thickness of a tether are plotted to show how buoyancy, stiffness and hydrostatic capacity varies.

FIG. 5 is a graphic representation of tether pipe utilization.

Samples of further variations in loads, dimensions and configurations are illustrated in Table 1. The embodiment suggests a wellhead platform in a West African environment. The deck weight includes the facilities, the structural steel, and the operational loads, including the riser tensions. The riser tensions are increased with water depth. The hull and displacement are increased to carry the deck load and the tether pretension.

The thick tether system represents the conventional tether having only one thickness, which has to have a large thickness-to-diameter ratio to withstand the hydro-static pressure at the bottom (i.e., near the sea bed). The stepped tether system represents the present invention, which allows for a reduction of the tether pretension. This allows for a reduction of the displacement and of the hull weight.

TABLE 1

| | | West Africa TLP Application | | | | | | | |
|---|---|---|---|---|---|---|---|---|---|
| WATER DEPTH | (m) | 1000 m | 1500 m | | 2000 m | | 3000 m | | |
| TETHER SYSTEM | (—) | THICK | THICK | STEPPED | THICK | STEPPED | THICK | STEPPED | MAX. STEP |
| DECK WEIGHT | (t) | 4,800 | 5,000 | 5,000 | 5,300 | 5,300 | 5,900 | 5,900 | 5,900 |
| RISER TENSION | (t) | 2,800 | 4,200 | 4,200 | 5,600 | 5,600 | 8,400 | 8,400 | 8,400 |
| HULL & BALLAST | (t) | 5,300 | 6,000 | 5,800 | 7,100 | 6,400 | 10,100 | 8,200 | 7,700 |
| TETHER | (t) | 2,400 | 3,300 | 2,600 | 5,500 | 3,000 | 13,000 | 6,200 | 4,500 |
| PRETENSION DISPLACEMENT | | 15,300 | 18,500 | 17,600 | 23,500 | 20,300 | 37,400 | 28,700 | 26,500 |
| TETHERS | | | | | | | | | |
| NO. OF DIAMETERS | | 1 | 1 | 2 | 1 | 2 | 1 | 5 | 10 |
| DIAMETER (top/bott.) | Inch | 26 | 30 | 46/24 | 32 | 52/28 | 34 | 56/30 | 56/30 |
| DIAMETER (top/bott.) | mm | 66 | 76 | 117/61 | 81 | 132/71 | 86 | 142/76 | 142/76 |
| THICKNESS (top/bott) | mm | 22.2 | 28.5 | 38.5/23 | 35.5 | 34.5/31 | 47.5 | 24.5/42 | 24.5/42 |
| MAX. LOAD - TOP | (kN) | 7,200 | 8,900 | 8,100 | 12,400 | 8,000 | 24,000 | 14,700 | 12,600 |
| WEIGHT in WATER | (t) | 0 | 70 | −10 | 300 | 20 | 1,100 | 300 | 70 |

DETAILED DESCRIPTION OF THE INVENTION

The following is a description of an embodiment provided by way of the following non-limiting example.

Figure 1:
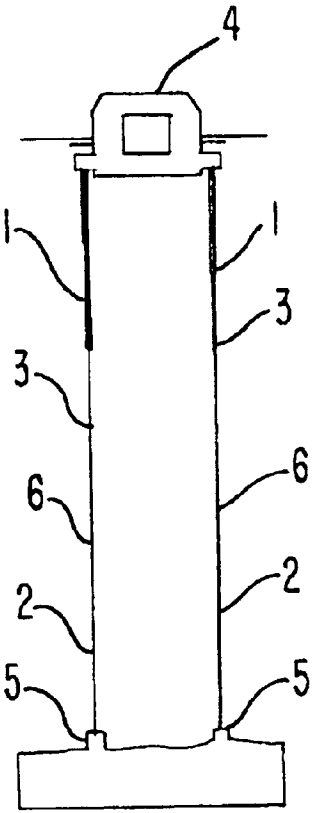
FIG. 1 is a schematic view showing a tension leg platform with tethers according to the present invention.
Figure 3:
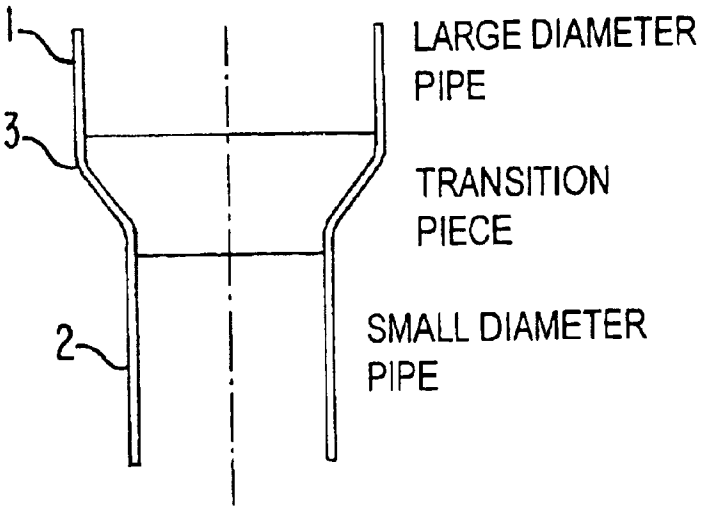
FIG. 3 is a cross sectional view of a diameter transition section.

A tension leg platform (4) with one step and two tethers (6) holding the plat-form is shown on FIG. 1. Each tether 6 includes a large-diameter upper section (1) and a small-diameter lower section (2), so that the sections have two different diameters. A transition piece (3) located between the tether sections is shown in FIG. 3 in detail. The upper section (1) of each tether (6) may have a diameter of 142 mm and a wall thickness of 24.5 mm, whereas the lower section (2) has an outer diameter of 76 mm and a wall thickness of 42 mm. The tethers are anchored to foundations (5).

Figure 2:
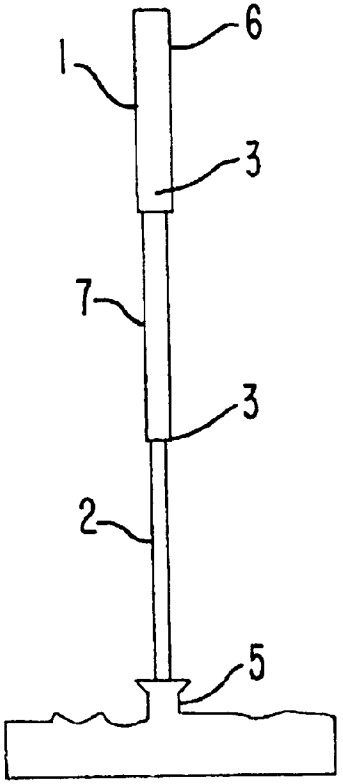
FIG. 2 is a schematic view showing a tether string according to the invention.

A tether with two steps (three sections) is shown on FIG. 2. The figure shows three tubular sections, including an upper section (1), a lower section (2), and an intermediate section (7), interconnected with two transition pieces (3). The three tubular sections have successively reduced diameters towards the sea bed. In other words, each section of the tether has a diameter smaller than the diameter of an adjacent section located farther from the sea bed.

The above described embodiments use steel as the construction material, but the invention is also meant to cover other materials such as composites.

What is claimed is:

1. A tension leg platform system, comprising:

a tension leg platform operable to float in the sea; and a plurality of hollow and empty tethers for anchoring said floating tension leg platform to the sea bed, said tethers being operable to withstand a tension force to be generated between said tension leg platform and the sea bed, each of said tethers including an upper section having a positive buoyancy and including a lower section having a greater pressure resistance than said upper section, said upper section of each of said tethers having a larger diameter than said lower section of each of said tethers such that each of said tethers has a stepped reduction in diameter from said tension leg platform toward the sea bed, each of said tethers further including an intermediate section between said upper section and said lower section, said intermediate section having a wall thickness larger than a wall thickness of said upper section and smaller than a wall thickness of said lower section such that each of said tethers has at least two stepped increases in wall thickness from said tension leg platform toward the sea bed.

2. The tether system of claim 1, wherein said intermediate section has a diameter smaller than a diameter of said upper section and larger than a diameter of said lower section such that each of said tethers has at least two stepped reductions in diameter from said tension leg platform toward the sea bed.

3. The tether system of claim 1, wherein said upper section of said tethers has a uniform cross sectional area along the height of said upper section.

4. The tether system of claim 1, wherein said upper section and said lower section of each of said tethers are made of steel.

5. The tether system of claim 1, wherein said upper section and said lower section tethers are made of composite materials.

6. A tether system for anchoring a tension leg platform to the sea bed, comprising:

a plurality of hollow and empty tethers operable to withstand a tension force to be generated between the tension leg platform and the sea bed, each of said tethers including an upper section having a positive buoyancy and including a lower section having a greater pressure resistance than said upper section, said upper section of each of said tethers having a larger diameter than said lower section of each of said tethers such that each of said tethers has a stepped reduction in diameter from the tension leg platform toward the sea bed, each of said tethers further including an intermediate section between said upper section and said lower section, said intermediate section having a wall thickness larger than a wall thickness of said upper section and smaller than a wall thickness of said lower section such that each of said tethers has at least two stepped increases in wall thickness from the tension leg platform toward the sea bed.

7. The tether system of claim 6, wherein said upper section of each of said tethers is shaped and arranged so as to compensate for the water weight of said lower section of each of said tethers.

8. The tether system of claim 6, wherein said lower section of each of said tethers has less buoyancy than said upper section of each of said tethers.

9. The tether system of claim 6, wherein said intermediate section has a diameter smaller than a diameter of said upper section and larger than a diameter of said lower section such that each of said tethers has at least two stepped reductions in diameter from the tension leg platform toward the sea bed.

10. The tether system of claim 6, wherein said upper section of each of said tethers has a uniform cross sectional area along the height of said upper section.

11. The tether system of claim 6, wherein said upper section and said lower section of each of said tethers are made of steel.

12. The tether system of claim 6, wherein said upper section and said lower section of each of said tethers are made of composite materials.

13. The tether system of claim 6, wherein each of said tethers has a substantially neutral buoyancy.

14. The tether system of claim 13, wherein said lower section of each of said tethers has less buoyancy than said upper section of each of said tethers.

15. The tether system of claim 13, wherein said upper section of each of said tethers has a uniform cross sectional area along the length of said upper section.

16. The tether system of claim 13, wherein said upper section and said tower section of each of said tethers are made of steel.

17. The tether system of claim 13, wherein said upper section and said lower section of each of said tethers are made of composite materials.

* * * * *

US006851894C1

(12) INTER PARTES REEXAMINATION CERTIFICATE (0327th)

United States Patent

Perret et al.

(10) Number: US 6,851,894 C1

(45) Certificate Issued: Dec. 6, 2011

(54) DEEP WATER TLP TETHER SYSTEM

(75) Inventors: Graham Perret, Sussex (GB); Henrik Hannus, Hövik (NO); Kjetil Eckhoff, Slependen (NO)

(73) Assignee: Aker Kvaerner Engineering & Technology AS, Lysaker (NO)

Reexamination Request:
No. 95/000,414, Dec. 11, 2008

Reexamination Certificate for:

| | |
|---|---|
| Patent No.: | **6,851,894** |
| Issued: | **Feb. 8, 2005** |
| Appl. No.: | **10/018,361** |
| Filed: | **Mar. 20, 2002** |

(22) PCT Filed: Jun. 22, 2000

(86) PCT No.: PCT/NO00/00215

§ 371 (c)(1),
(2), (4) Date: Mar. 20, 2002

(87) PCT Pub. No.: WO00/78601

PCT Pub. Date: Dec. 28, 2000

(30) Foreign Application Priority Data

Jun. 23, 1999 (NO) ..... 19993116

(51) Int. Cl.
*E02D 29/09* (2006.01)

(52) U.S. Cl. ..... 405/223.1

(58) Field of Classification Search ..... None
See application file for complete search history.

(56) References Cited

To view the complete listing of prior art documents cited during the proceeding for Reexamination Control Number 95/000,414, please refer to the USPTO's public Patent Application Information Retrieval (PAIR) system under the Display References tab.

*Primary Examiner*—Glenn K. Dawson

(57) ABSTRACT

A tether system include tethers each having an upper section (1) attached to a tension leg platform (TLP) (4), and each upper section has a large diameter so that the upper section (1) is positively bouyant. This buoyancy can be designed to compensate for the weight of the lower section (2) of each tether, so as to make the total buoyancy of each tether closer to neutral. The selection process for each section is driven by requirements for buoyancy, stiffness and external pressure resistance.

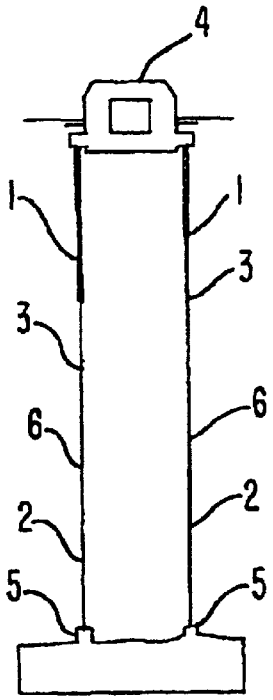

TLP WITH TETHERS

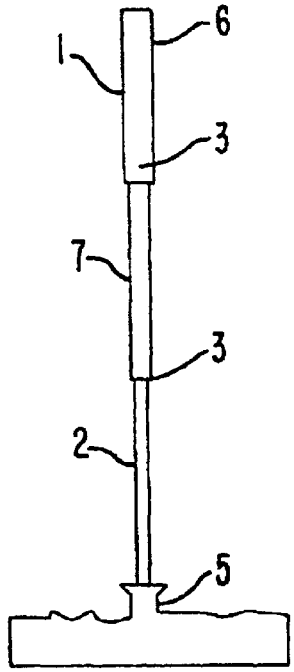

TETHER STRING

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-17 are cancelled.

* * * * *